US006742997B2

(12) United States Patent
Murata

(10) Patent No.: US 6,742,997 B2
(45) Date of Patent: Jun. 1, 2004

(54) DIAPHRAGM-TYPE PUMPING APPARATUS

(75) Inventor: Shigeru Murata, Tokyo (JP)

(73) Assignee: Yamada Corporation, Tokyo (JP)

( * ) Notice: Subject to any disclaimer, the term of this patent is extended or adjusted under 35 U.S.C. 154(b) by 0 days.

(21) Appl. No.: 10/303,968

(22) Filed: Nov. 26, 2002

(65) Prior Publication Data

US 2003/0101865 A1 Jun. 5, 2003

(30) Foreign Application Priority Data

Dec. 5, 2001 (JP) ..... 2001/371325

(51) Int. Cl.[7] ..... F04B 45/00
(52) U.S. Cl. ..... 417/395
(58) Field of Search ..... 417/393, 394, 417/395

(56) References Cited

U.S. PATENT DOCUMENTS

| | | | | |
|---|---|---|---|---|
| 3,672,791 A | | 6/1972 | Zimmerly | |
| 4,923,168 A | * | 5/1990 | Murata et al. | 91/346 |
| 5,062,770 A | | 11/1991 | Story et al. | |
| 5,261,798 A | * | 11/1993 | Budde | 417/393 |
| 5,558,506 A | * | 9/1996 | Simmons et al. | 417/393 |
| 5,833,439 A | | 11/1998 | Du | |

FOREIGN PATENT DOCUMENTS

| | | | | |
|---|---|---|---|---|
| EP | 0 318 596 | | 6/1989 | |
| EP | 775825 | A2 * | 5/1997 | 417/393 |

* cited by examiner

*Primary Examiner*—Cheryl J. Tyler
(74) *Attorney, Agent, or Firm*—Wenderoth, Lind & Ponack, L.L.P.

(57) ABSTRACT

A diaphragm-type pumping apparatus (1) includes a pair of diaphragms (12), each defining a fluid delivering chamber (14) and a working fluid chamber (15), a main body section (2) operatively supporting a center rod (11) so as to allow a reciprocating motion thereof, and a pair of casing members (3), arranged so as to hold the main body section 2 from opposite sides thereof and functioning in association with the main body section (2) to clamp the peripheral portions (42), of the respective diaphragms (12), from opposite sides along a thickness direction thereof. The diaphragm has an annular lip section (43) extending in either side along a direction of the reciprocation motion of the center rod (11) and also along the thickness direction of the diaphragm 12. An annular wall section (28) for defining an annular recess (27) is formed in the casing member (3), and an annular threaded member (44) is engaged with an outer surface of the annular wall section (28) for compressing the annular lip section (43) against the main body section (2) and the casing member (3).

20 Claims, 7 Drawing Sheets

DIAPHRAGM-TYPE PUMPING APPARATUS

BACKGROUND OF THE INVENTION

The present invention relates to an improvement in a diaphragm-type pumping apparatus comprising: a main body section operatively supporting a center rod so as to allow a reciprocating motion thereof. The center rod is provided with a pair of diaphragms attached to both sides thereof respectively. A pair of casing members arranged so as to hold the main body section from opposite sides, which function in association with the main body section to clamp peripheral portions of respective diaphragms from the opposite sides along a thickness direction thereof. The fluid is sucked through a fluid suction port and discharged from a fluid discharge port by reciprocating the center rod.

As for a diaphragm-type pumping apparatus, such an apparatus has been known that comprises: a pair of disc-like diaphragms, each having a diaphragm section for defining a fluid delivering chamber and a working fluid chamber; a main body section operatively supporting a center rod so as to allow a reciprocating motion thereof, each of said diaphragms being mounted at a central portion thereof to each end of said center rod respectively; and a pair of casing members having communicating channels formed therein for providing a communication between a fluid suction port and a fluid discharge port via a fluid delivering chamber and being arranged so as to hold said main body section from opposite sides to function in association with said main body section for clamping peripheral portions of said respective diaphragms from opposite sides along a thickness direction thereof (see, for example, the Japanese Patent Publication No. Hei 6-31650).

In this conventional diaphragm-type pumping apparatus, typically, working fluid is supplied to one working fluid chamber located in one diaphragm side and to the other working fluid chamber located on the other diaphragms side alternately, and in response to this change-over in supply of the working fluid to those two working fluid chambers, the center rod is reciprocated so as to induce a volume expansion of the one working chamber and that of the other working chamber alternately, so that the fluid can be sucked from a fluid suction port into respective fluid delivering chambers alternately thus to exhaust the fluid, which has been sucked into respective fluid delivering chambers, from respective fluid delivering chambers alternately, thereby discharging the fluid from the fluid discharge port successively.

In this conventional diaphragm-type pumping apparatus, the peripheral portions of respective diaphragms are clamped between the main body section and the respective casing members disposed in opposite sides thereof, in which the main body section and a pair of casing members are fastened together along the thickness directions of the diaphragms with tie rod screw members so as to clamp the peripheral portions of the diaphragms between the casing members and the main body section.

Accordingly, there has been a problem due to this configuration in that, if Teflon (registered trademark) is used as a material of the casing member, a degree of expansion and contraction thereof in association with the temperature change would be large because Teflon (registered trademark) material itself has a greater coefficient of linear expansion as compared to a metal, and consequently, in the conventional configuration in which the peripheral portions of the diaphragms are simply clamped along its thickness direction in the clamping portions between a pair of casing members and the main body section by the tie rod screw members, it is likely to cause a looseness in the clamping portions, resulting in leakage of the working fluid or the fluid to be delivered, from the clamping portions to the outside.

That is, since Teflon (registered trademark) material is soft and apt to be deformed in the range of the room temperature (23° C.) but in contrast the tie rod screw member is made of stainless steel, and accordingly, even if a pair of casing members and the main body section are clamped and fastened together as three in one body with tie rod screw members under the room temperature environment, when the temperature drops in the operational environment, the casing member would be contracted along an extending direction of the tie rod screw member by an amount greater than the contracting amount of the tie rod screw member, there would occur such an apparent condition that the fastening of the pair of casing members and the main body section by the tie rod screw members has been loosened, resulting in a problem that a gap is produced in the clamping portion of the diaphragm, through which the working fluid or the fluid to be delivered leaks to the outside.

SUMMARY OF THE INVENTION

To overcome this problem, when the diaphragm-type pumping apparatus is to be operated in an operational environment of lower temperature, the tie rod screw members are further tightened to increase the fastening force between the pair of casing members and the main body section before starting the operation of the apparatus. However, since the casing member is expanded more than the tie rod screw member along the extending direction of the tie rod screw member when the temperature rises in the operational environment, the fastening force between the casing members and the main body section also rises up to an excessively tightened condition and thereby the casing member is deformed, which might shorten the life-time of the diaphragm-type pumping apparatus.

Further, this diaphragm-type pumping apparatus also involves another problem in that, due to the looseness induced in the clamping portion where the peripheral portion of the diaphragm is clamped, the peripheral portion of the diaphragm sometimes slips so as to be pulled out of the clamping portion during the reciprocating motion of the center rod, resulting in a breakdown of the apparatus.

The present invention has been made in the light of the circumstances described above, and an object thereof is to provide a diaphragm-type pumping apparatus which can prevent the working fluid or the fluid to be delivered from being leaked through the clamping portion for clamping the peripheral portion of the diaphragm between the main body section and the casing member while preventing the peripheral portion of the diaphragm from being pulled out of the clamping portion between the main body section and the casing member during the reciprocating motion of the center rod thus to extend the life of the apparatus.

According to the present invention, there is provided a diaphragm-type pumping apparatus comprising: a pair of disc-like diaphragms, each having a diaphragm section for defining a fluid delivering chamber and a working fluid chamber; a main body section operatively supporting a center rod so as to allow a reciprocating motion thereof, said pair of diaphragms being attached at central portions thereof to respective ends of said center rod; and a pair of casing members arranged so as to hold said main body section from opposite sides thereof and functioning in association with said main body section to clamp peripheral portions of said respective diaphragms from opposite sides along a thickness direction thereof, in which a fluid is sucked through a fluid suction port and discharged from a fluid discharge port by reciprocating said center rod in response to a change-over in supplying a working fluid to said respective working fluid chambers.

The diaphragm-type pumping apparatus is characterized in that the casing member is made of Teflon (registered trademark) material. The diaphragm has an annular lip section formed in an outer circumferential portion defined so as to be further outside of a peripheral portion thereof and extends along a direction of a reciprocating motion of said center rod and also along a thickness direction of the diaphragm. Also, either one of the casing member or the main body section is provided with an annular wall section, which forms an annular recess for accommodating an ingress of the annular lip section.

Also, according to another aspect of the present invention, there is provided a diaphragm-type pumping apparatus in which the casing member has a communicating channel formed therein for providing a communication between the fluid suction port and the fluid discharge port via said fluid delivering chamber.

According to another aspect of the present invention, there is provided a diaphragm-type pumping apparatus, in which the main body section has a communicating channel formed therein for providing a communication between the fluid suction port and the fluid discharge port via the fluid delivering chamber.

According to another aspect of the present invention, there is provided a diaphragm-type pumping apparatus, in which a threaded section is formed on a outer surface of the annular wall section, and an annular threaded member is engaged with the threaded section for compressing the annular lip section toward a clamping portion between the main body section and the casing member.

According to another aspect of the present invention, there is provided a diaphragm-type pumping apparatus, in which the annular recess is formed such that an approach channel for the annular lip section is made to be narrower gradually from an entrance port toward an innermost portion thereof.

According to another aspect of the present invention, there is provided a diaphragm-type pumping apparatus, in which the annular threaded member has a compressing wall section for compressing the annular lip section directly or indirectly along a thread traveling direction for pushing the annular lip section into the annular recess.

According to another aspect of the present invention, there is provided a diaphragm-type pumping apparatus, in which the diaphragm is made of Teflon (registered trademark).

According to another aspect of the present invention, there is provided a diaphragm-type pumping apparatus, in which a cylinder section is formed in a central portion of the diaphragm and further a threaded section is formed on an inner surface of the cylinder section so as to be engaged with a threaded section of the center rod, and another threaded section is formed on an outer surface of the cylinder section. Also, a reinforcing ring member is engaged with the threaded section formed on said outer surface of the cylinder section so as to clamp the cylinder section in association with said center rod from either side, and the center rod is made of PPS.

According to another aspect of the present invention, there is provided a diaphragm-type pumping apparatus, in which the reinforcing ring member is made of PP or PVC.

According to another aspect of the present invention as defined in claim 10, there is provided a diaphragm-type pumping apparatus, in which an O-ring is arranged in a contact location of the main body section with the annular lip section.

DETAILED DESCRIPTION OF THE INVENTION

Figure 1:
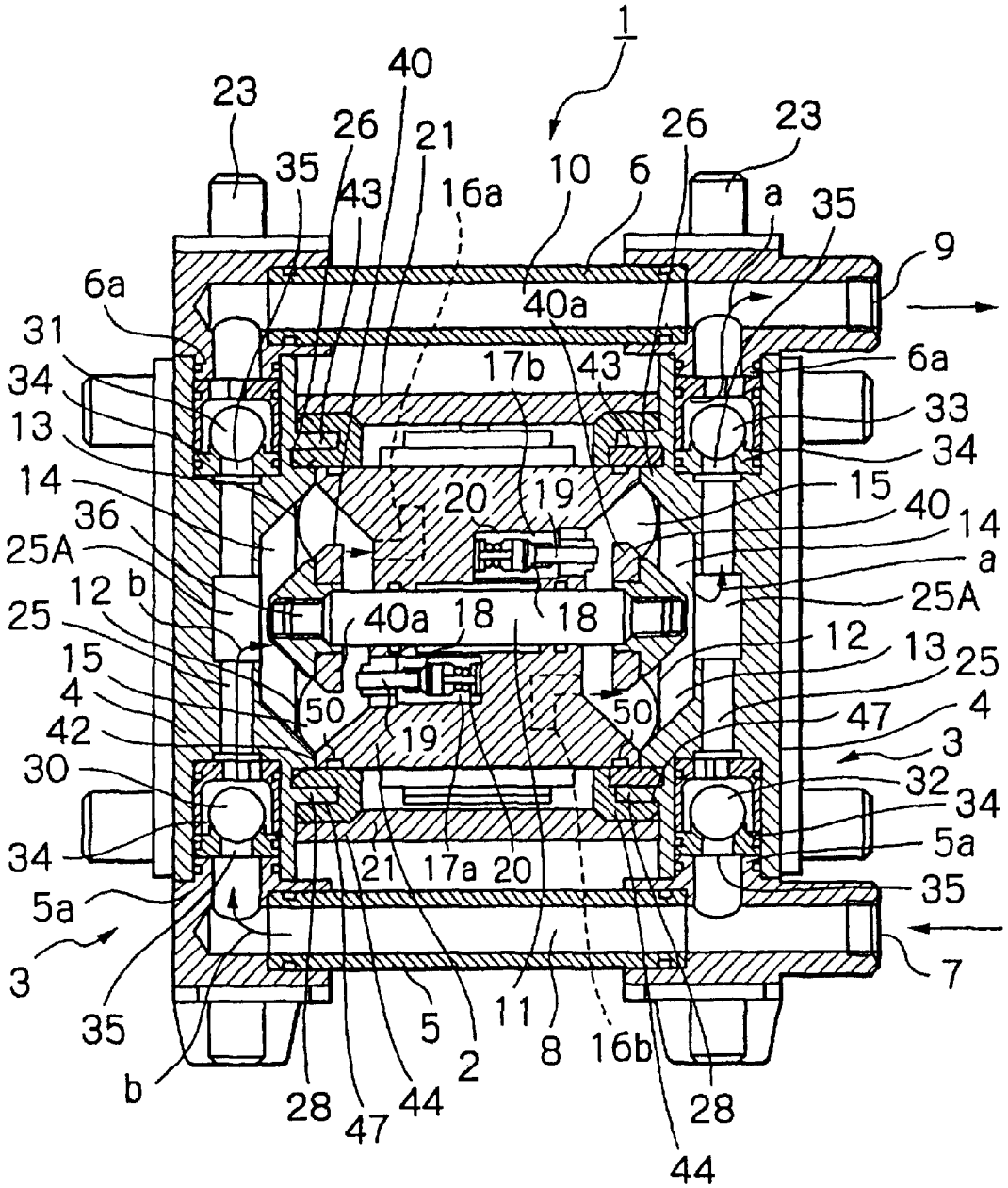
FIG. 1 is a longitudinal sectional view of a diaphragm-type pumping apparatus according to the present invention.

FIG. 1 is a longitudinal sectional view of a diaphragm-type pumping apparatus according to the present invention, wherein reference numeral 1 generally designates a diaphragm-type pumping apparatus. The diaphragm-type pumping apparatus 1 comprises a main body section 2 and a pair of casing members 3, 3 disposed on opposite sides of the main body section 2. Stainless steel (SUS) is used as a material to form the main body section 2 and an outer surface thereof is coated with Teflon (registered trademark). Teflon is also used as a material to form the pair of casing members 3, 3.

The pair of casing members 3, 3 comprises a pair of outer chamber members 4, 4, a suction manifold member 5, and a discharge manifold member 6. The suction manifold member 5 has a fluid suction port 7 and a fluid delivering channel 8. The discharge manifold member 6 has a fluid discharge port 9 and a fluid delivering channel 10. The main body section 2 operatively supports at a central portion thereof a center rod 11 so as to allow a reciprocating motion thereof. A pair of diaphragms 12, 12 is attached to the opposite ends of the center rod 11. Each of the diaphragms 12 has a curved diaphragm section 13, which serves to define a fluid delivering chamber 14 and a working fluid chamber 15.

The main body section 2 is further provided with communicating ports 16*a* and 16*b*, each being in communication with a change over valve, though not shown, and changeover pressure reducing holes 17*a* and 17*b*. The communicating ports 16*a* and 16*b* function for supplying compressed air functioning as the working fluid from the change-over valve into the working fluid chamber 15 and for discharging the compressed air in the working fluid chamber to the outside atmosphere via the change-over valve.

Figure 2:
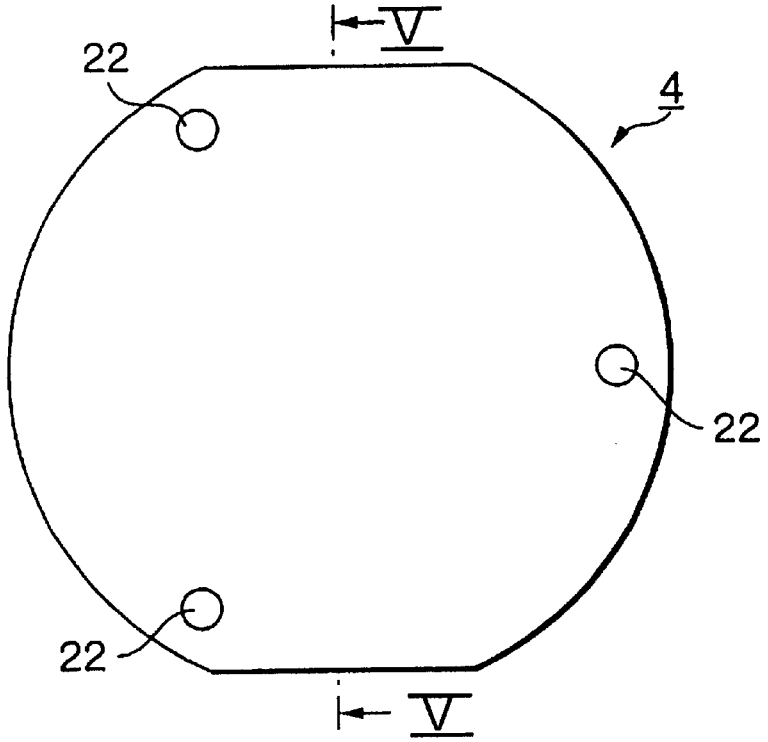
FIG. 2 is an enlarged plan view of an outer chamber member shown in FIG. 1.

The main body section 2 also includes a push rod 19 having an on-off valve body 18 incorporated therein as one body for opening or closing the change-over pressure reducing hole 17*a* or 17*b*. The push rod 19 is biased by a coil spring 20 toward the working fluid chamber 15 so as to be protruded thereinto. Each of the outer chamber members 4 is provided with, in a peripheral portion thereof, three through holes 22 extending horizontally through which tie rod threaded member 21 is to be inserted, as shown in the enlarged views in FIGS. 2 and 3, and a pair of through holes 24, 24 extending in the up and down direction through which tie rod threaded members 23, 23 are to be inserted, as shown in FIGS. 3 and 4.

Figure 3:
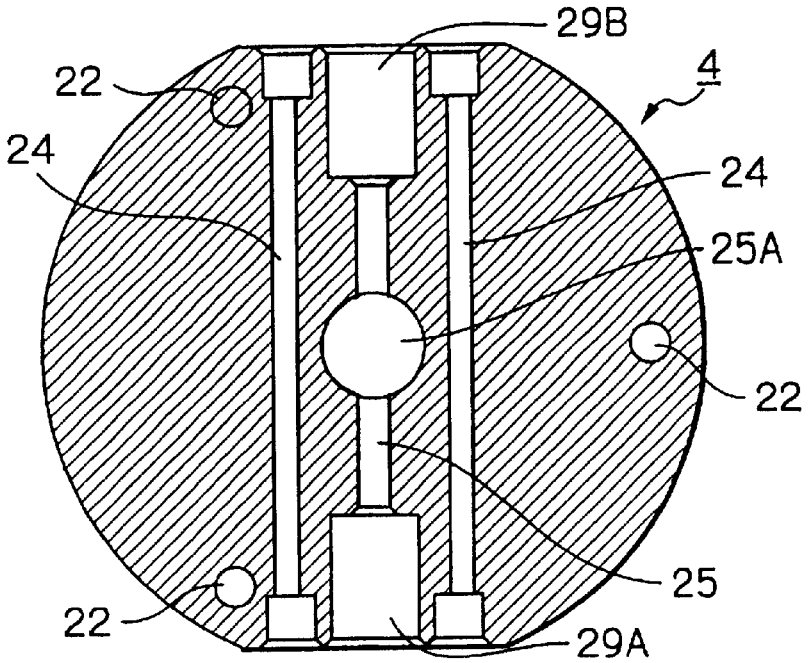
FIG. 3 is a sectional view of the outer chamber member taken along the line III—III of FIG. 4.
Figure 4:
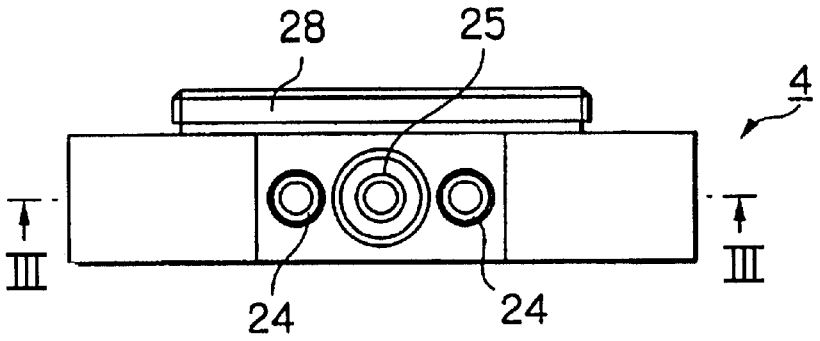
FIG. 4 is a top view of the outer chamber member shown in FIG. 2.
Figure 5:
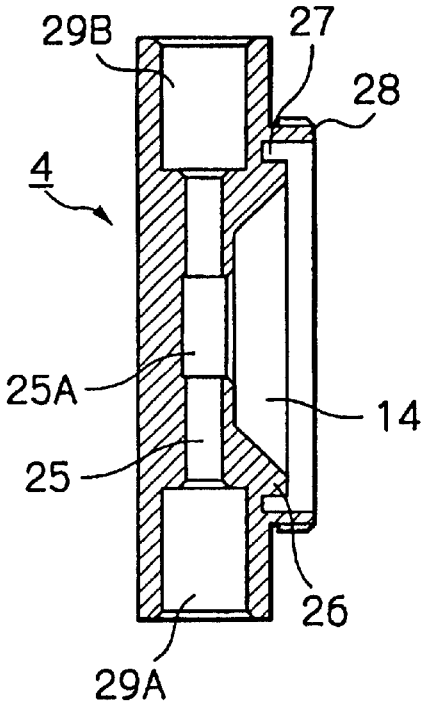
FIG. 5 is a sectional view of the outer chamber member taken along the line V—V of FIG. 2.

In each of the outer chamber members 4, 4, a through hole 25 is formed between the pair of through holes 24, 24 as shown in FIGS. 3 to 5, which extends in the up and down direction to form a communicating channel. Further, in one sidewall of each of the outer chamber members 4, 4 are formed a fluid delivering chamber structure wall 26 defining the fluid delivering chamber 14 and an annular wall section 28 defining an annular recess 27 surrounding the fluid delivering chamber structure wall 26. Each of the pair of outer chamber members 4, 4 is made so as to be a thin-walled member in order to as much as possible, the quantity of thermal expansion and contraction along the thickness direction.

A lower portion of the through hole 25 functions as a fitting section 29A with which a cylinder section 5*a* of the suction manifold member 5 is to be fitted and an upper portion of the through hole 25 functions as a fitting section 29B with which a cylinder section 6*a* of the discharge manifold member 6 is to be fitted. The through hole 25 is in communication with the fluid delivering chamber 14 through a hemispheric space 25A disposed between the two fitting sections 29A and 29B. In both fitting sections 29A and 29B, ball valves 30 to 33 are arranged respectively. Each of the fitting sections 29A and 29B is provided with a valve seat 34, and a communicating channel 35 is formed in the valve seat 34.

Figure 6:
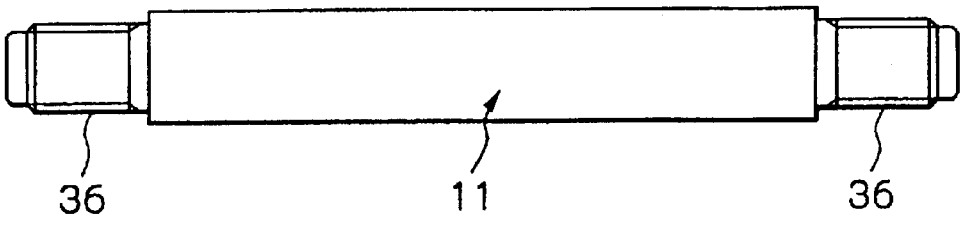
FIG. 6 is an enlarged side view of a center rod shown in FIG. 1.

At either end of the center rod 11, a threaded section 36 is formed on an outer surface thereof, as shown in FIG. 6 in an enlarged scale. PPS may be used as a material of the center rod 11. Teflon (registered trademark) may be used as a material of the diaphragm 12.

Figure 7:
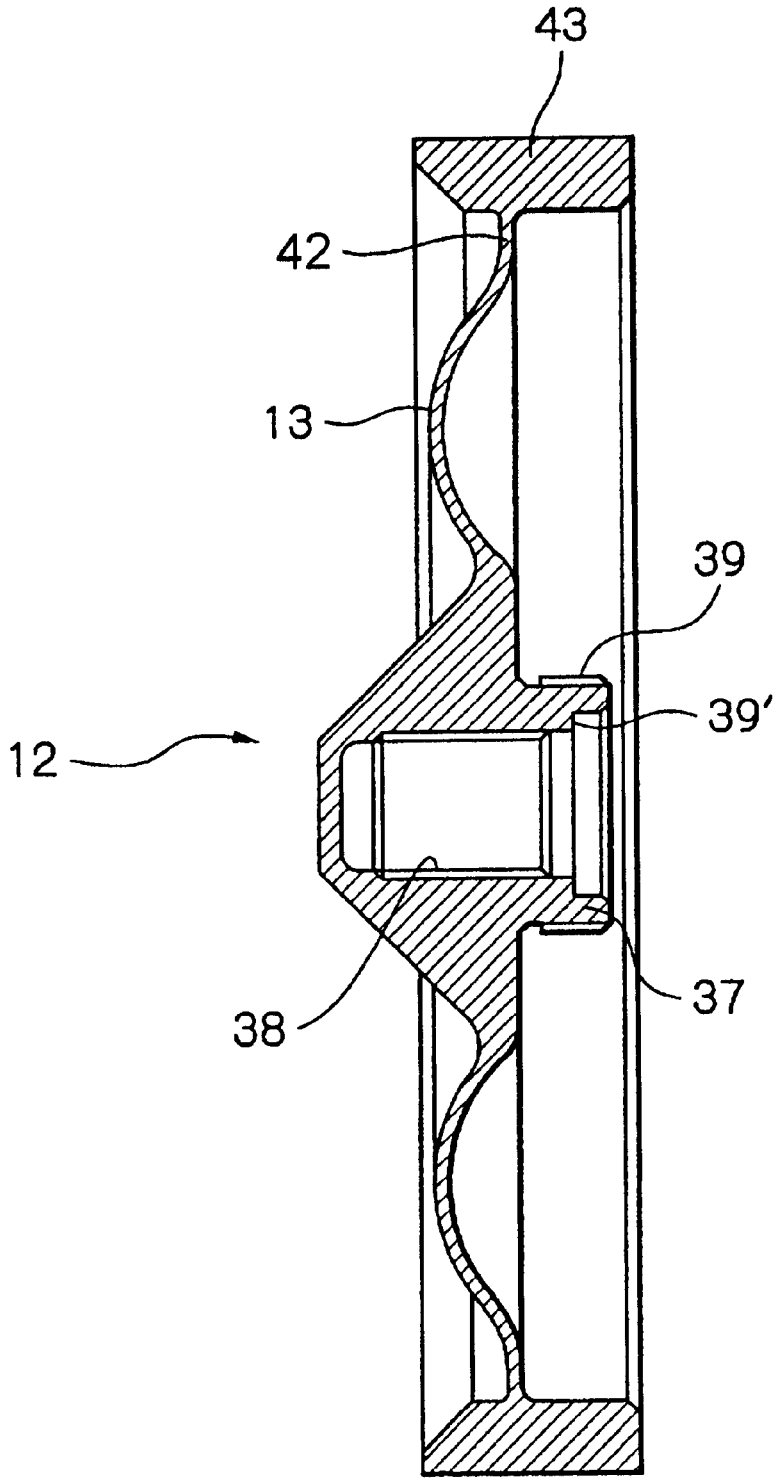
FIG. 7 is an enlarged sectional view of a diaphragm shown in FIG. 1.

A cylinder section 37 is formed in a central portion of the diaphragm 12, as shown in an enlarged view of FIG. 7, and also a threaded section 38 is formed therein so as to be engaged with the threaded section 36 formed at the either end portions of the center rod 11. By way of this configuration, the diaphragm 12 and the center rod 11 are fastened to each other to form a screw-in connection.

Figure 8:
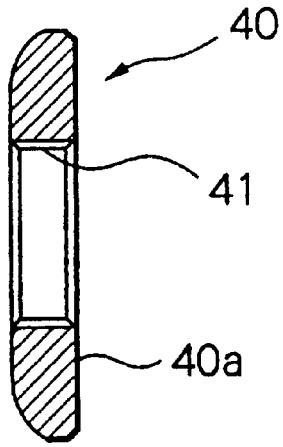
FIG. 8 is an enlarged sectional view of a reinforcing ring member shown in FIG. 1.

A threaded section 39 is formed on an outer surface of the cylinder section 37. An annular step section 39' is formed on an inner surface of the cylinder section 37. This cylinder section 37 is to be reinforced by a ring member 40, which is shown in the enlarged view of FIG. 8.

A threaded section 41 is formed on an inner surface of the reinforcing ring member 40, with which the threaded section 39 formed on the outer surface of the cylinder section 37 is to be engaged. PP (polypropylene) or PVC (polyvinyl chloride) may be used as a material of the reinforcing ring member 40. The reinforcing ring member 40 functions in association with the center rod 11 so as to clamp the cylinder section 37 from the opposite sides, and thereby ensures that the center rod 11 is prevented from being pulled out of the diaphragm 12 during operation of the diaphragm-type pumping apparatus 1. That is, this prevents the cylinder section 37, which is stressed by the reciprocating motions of the center rod 11, from being expanded in its diameter. The protruding end of the push rod 19 is arranged so as to face to one sidewall face 40*a* of the reinforcing ring member 40. During the reciprocating motions of the center rod 11, the reinforcing ring member 40 comes in contact with the protruding end of the push rod 19 in a working fluid chamber whose volume is reducing, so as to move the push rod 19 in the direction against the bias force from the coil spring 20, thereby bringing the on-off valve body 18 into an open-state.

The diaphragm 12 is formed into a specific shape with the wall thickness thereof becoming gradually thinner from the central portion toward the diaphragm section 13 thereof as shown in FIG. 7. In contrast to the prior art, in which the diaphragm is made of thinner Teflon (registered trademark) plate having a certain thickness and a curved diaphragm section thereof is formed by blow-molding this thinner Teflon (registered trademark) plate, employing the shape of the diaphragm 12 having the wall thickness that becomes gradually thinner from the central portion toward the diaphragm section 13 provides uniform distribution of the stress applied to the diaphragm section 13.

The diaphragm section 13 is formed into a curved shape having a predetermined thickness and a peripheral portion 42 disposed in an outer side of the diaphragm section 13, which serves as a clamp section to be clamped between the main body section 2 and the outer chamber member 4. The diaphragm 12 also includes an annular lip section 43 formed on an outer circumferential portion defined to be further outside of the peripheral portion 42. The annular lip section 43 extends toward both sides along the thickness direction of the diaphragm.

The main body 2 and the outer chamber member 4 are fastened together by three tie rod screw members 21 with the peripheral portion 42 of the diaphragm 12 interposed therebetween so as to be clamped along the thickness direction thereof.

Figure 9:
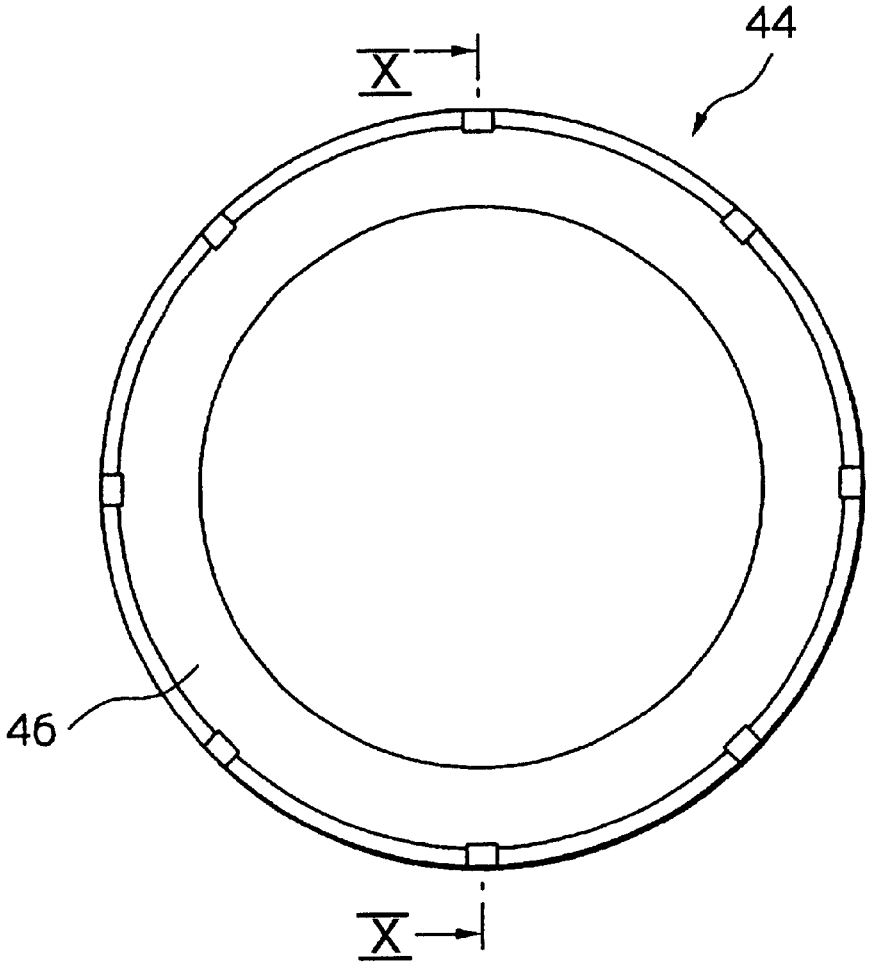
FIG. 9 is an enlarged plan view of an annular threaded member shown in FIG. 1.
Figure 10:
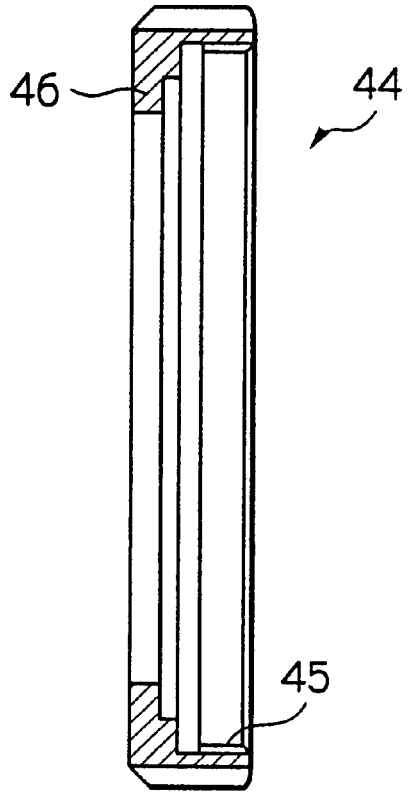
FIG. 10 is a sectional view of the annular threaded member taken along the line X—X of FIG. 9.

The annular lip section 43 is pushed into the annular recess 27 by an annular threaded member 44 shown in FIG. 9, and the annular threaded member 44 includes a threaded section 45 formed in an inner surface thereof, as shown in FIG. 10. Further, the annular threaded member 44 includes a compressing wall section 46, which comes into direct contact with the annular lip section 43 along the thread traveling direction.

Figure 11:
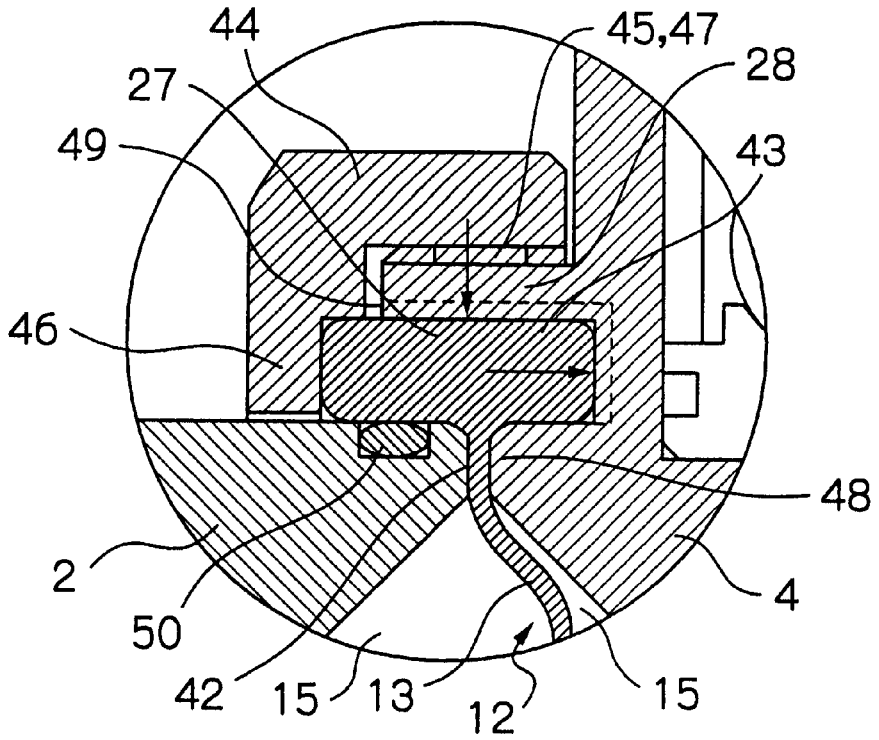
FIG. 11 is a partially enlarged sectional view for illustrating an annular wall section and the annular threaded member being fastened to each other.

On an outer surface of the annular wall section 28 defining the annular recess 27, a threaded section 47 to be engaged with the threaded section 45 of the annular threaded member 44 is formed as shown in FIG. 11 in an enlarged scale. The annular lip section 43 is compressed so as to be deformed by the annular threaded member 44 toward a clamping portion 48 of the peripheral portion 42 between the main body 2 and the outer chamber member 4. At that time, the annular lip section 43 is uniformly compressed by the annular threaded member 44 via the annular wall section 28.

In the annular recess 27, an approach channel for the annular lip section 43 becomes narrower gradually from an entrance port 49 for the annular lip section 43 toward the innermost portion thereof, in which the inner surface of the annular wall section 28 is formed into a tapered surface such that the approach channel for the annular lip section 43 becomes narrower gradually from the entrance port 49 toward the innermost portion. This structure can provide a sealing face defined as an area indicated by the dotted line, which ensures that the fluid to be delivered is prevented from leaking through the clamping portion 48 between the main body section 2 and the outer chamber member 4.

The main body section 2 includes an O-ring 50 disposed in a contact location with the annular lip section 43 and thereby ensures that any leakage of the working fluid from the working fluid chamber 15 to the outside is prevented.

After the main body 2 has been joined with a pair of outer chamber members 4, 4 along a horizontal direction and the annular lip section 42 has been compressed and deformed by using the annular threaded member 44 to ensure that the diaphragm 12 is firmly clamped between the main body section 2 and the outer chamber member 4, the suction manifold 5 and the discharge manifold 6 are fastened to the outer chamber members 4, 4 by using four tie rod screw members 23 from the up and down directions.

An operation of this diaphragm-type pumping apparatus will now be generally described.

Now referring to FIG. 1, it is assumed that the compressed air functioning as the working fluid is being supplied from the change-over valve (not shown) via the communicating port 16*b* to the working fluid chamber 15 located in the right hand side and the center rod 11 is traveling in the rightward direction, wherein the volume of the working fluid chamber 15 in the right hand side is increasing while simultaneously the compressed air in the working fluid chamber 15 located in the left hand side is exhausted through the communicating port 16*a* via the change-over valve to the outside atmosphere and thus the volume of the working fluid chamber 15 in the left hand side is reducing. That is, in this assumption, the diaphragm-type pumping apparatus is in the condition where the fluid delivering chamber 14 located in the right hand side is in the course of decreasing its volume, while the fluid delivering chamber 14 located in the left hand side is in the course of increasing its volume.

At that time, the pressure in the fluid delivering chamber 14 in the right hand side is increased to bring the ball valve 32 into contact with the valve seat 34 on the side of the suction manifold member 5, and the ball valve 33 is spaced away from the valve seat 34 on the side of the discharge manifold member 6, thereby allowing the fluid in the fluid delivering chamber 14 in the right hand side to be discharged from the fluid discharge port 9 via the through hole 25 in the right hand side, as indicated by the arrow "a". On the other hand, the pressure in the fluid delivering chamber 14 in the left hand side is decreased to cause the ball valve 30 to be spaced away from the valve seat 34 on the side of the suction manifold member 5 and the ball valve 31 to come into contact with the valve seat 34 on the side of the discharge manifold member 6, thereby allowing the fluid to be sucked into the fluid delivering chamber 14 in the left hand side from the fluid suction port 7 via the through hole 25 in the left hand side, as indicated by the arrow "b".

As the one sidewall face 40*a* of the reinforcing ring member 40 in the left hand side has come into contact with the protruding end of the push rod 19 in the left hand side, the push rod 19 in the left hand side is moved in the direction against the bias force from the coil spring 20 and causes the on-off valve 18 to bring the change-over pressure reducing hole 17*a* into the open state, so that the air in the change-over pressure chamber (not shown) of the change-over valve can flow into the working fluid chamber 15 in the left hand side via the change-over pressure reducing hole 17*a* and then the air is exhausted to the outside atmosphere through the communicating port 16*a*, and thereby the change-over valve is switched instantaneously to cause the compressed air from the change-over valve to be supplied into the working fluid chamber 15 in the left hand side via the communicating port 16*a* thus to increase the volume of the working fluid chamber 15 in the left hand side.

This also causes the center rod 11 to move in the leftward direction, and this leftward travel of the center rod 11 reduces the volume of the fluid delivering chamber 14 in the left hand side thus to increase the pressure therein, which in turn causes the ball valve 30 to come into contact with the valve seat 34 on the side of the suction manifold member 5 and the ball valve 31 to be spaced away from the valve seat 34 on the side of the discharge manifold member 6, thereby allowing the fluid in the fluid delivering chamber 14 in the left hand side to be discharged from the fluid discharge port 9 via the through hole 25 in the left hand side.

On the other hand, the working fluid in the working fluid chamber 15 in the right hand side is exhausted to the outside atmosphere from the change-over valve via the communicating port 16*b* thus to reduce the volume of the chamber, and the volume of the fluid delivering chamber 14 in the right hand side is increased thus to decrease the pressure therein, thereby causing the ball valve 32 to be spaced away from the valve seat 34 on the side of the suction manifold member 5 and the ball valve 33 to come into contact with the valve seat 34 on the side of the discharge manifold member 6.

This allows the fluid to be sucked from the fluid suction port 7 into the fluid delivering chamber 14 in the right hand side via the through hole 25. Based on the repeated reciprocating motions of the center rod 11, the fluid to be delivered is sucked into either fluid delivering chamber 14, 14, alternately, while the fluid which has been sucked into the either fluid delivering chamber 14, 14 is discharged successively from the fluid discharge port 9. It is to be notified that the effect of the change-over valve in this diaphragm-type pumping apparatus 1 has been described in more detail, for example, in the Japanese Patent Publication No. Hei 6-31650.

DESCRIPTION OF AN ALTERNATIVE EMBODIMENT

Figure 12:
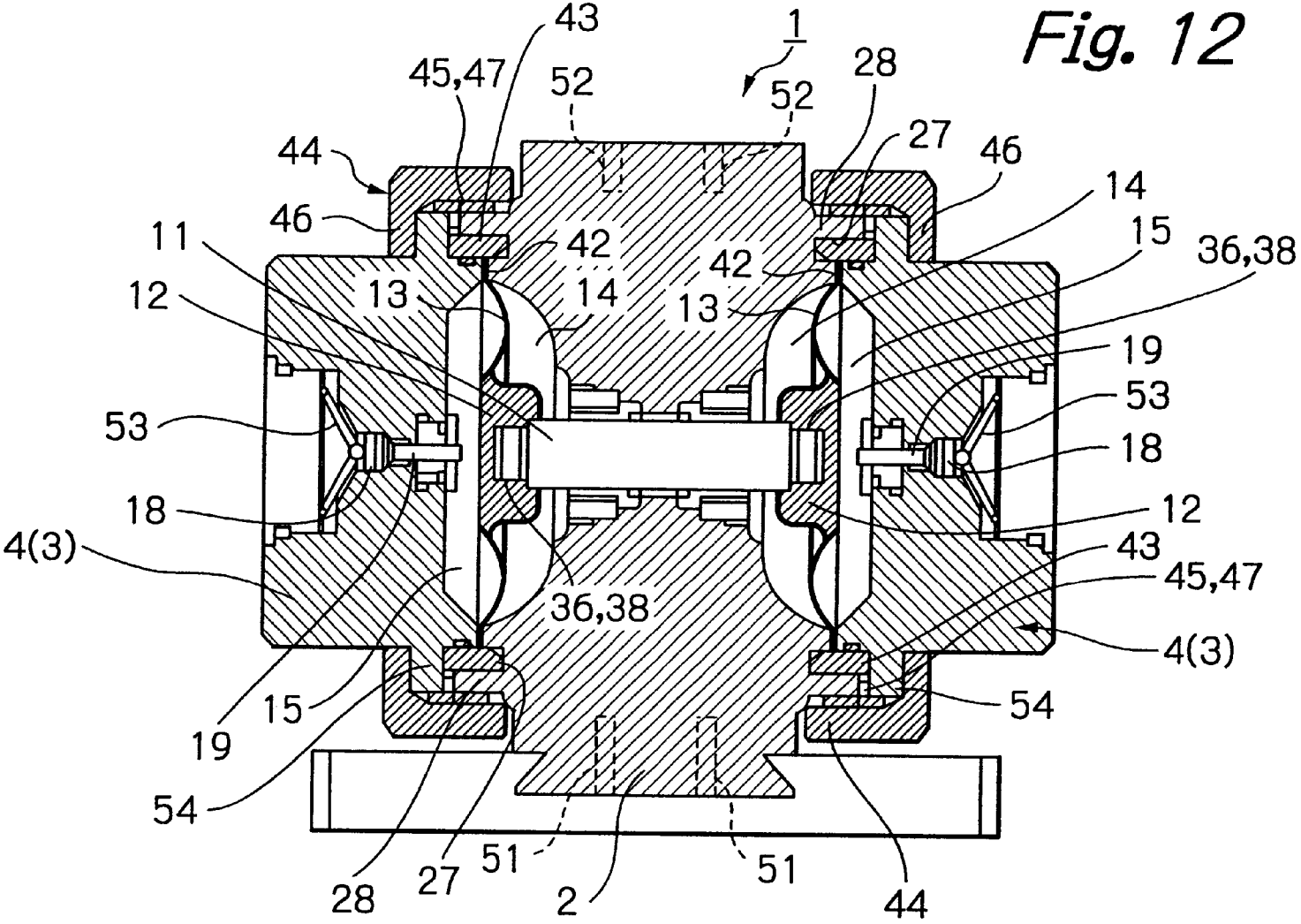
FIG. 12 is a longitudinal sectional view of an alternative embodiment of the diaphragm-type pumping apparatus derived from that shown in FIG. 1 according to the present invention.

FIG. 12 shows a diaphragm-type pumping apparatus 1 of an alternative embodiment according to the present invention, in which communicating channels 51 and 52, which establish the communication between a fluid suction port 7 and a fluid discharge port 9, are formed in a main body section 2.

Besides, a fluid delivering chamber 14 is formed on the side of the main body section 2, and a working fluid chamber 15 is formed on the side of an outer chamber member 4 in which a push rod 19 is also disposed. A protruding end of the push rod 19 has been made into a configuration so as to be face a central portion of a diaphragm 12.

In this structure, the contact of the central portion of the diaphragm 12 with the protruding end of the push rod 19 may cause the push rod 19 to move in the direction against a bias force from a spring 53 thus to bring an on-off valve body 18 into an open state. In the main body section 2, an annular wall section 28 is formed to provide an annular recess 27 for permitting an ingress of an annular lip section 43.

In the outer chamber member 4, a contact flange section 54 is formed so as to come in contact with a compressing wall section 46 of an annular threaded member 44. The main body section 2 and the outer chamber member 4 can be fastened together by engaging the annular threaded member 44 with a threaded section 47 formed on an outer surface of the annular wall section 28. Upon this fastening, the annular lip section 43 is pressed indirectly by the compressing wall section 46 and is pushed into the annular recess 27.

According to this configuration, since the main body section 2 and the outer chamber member 4 are fastened together into one unit by the annular threaded member 44, there will be no need for a tie rod screw member 21 for clamping the main body section 2 and the outer chamber members 4, 4 as one body along the horizontal directions.

Further, since in this configuration, the main body section 2 and the outer chamber member 4 are fastened together uniformly along a full-round of the annular threaded member 44 as a whole, the clamping pressure can be prevented from being applied locally in a concentrated manner to the main body section 2 and the outer chamber member 4, and thus the outer chamber member 4 can be prevented from being deformed.

According to the present invention, the diaphragm-type pumping apparatus has employed the configuration, in which the annular lip section formed in the outer peripheral portion of the diaphragm is compressed against the main body section and the casing member from the direction diagonal to the wall thickness of the diaphragm by using the annular threaded member thus to seal a clamping portion where the peripheral portion of the diaphragm is clamped between the main body section and the casing member, thereby allowing for the thermal expansion and contraction of the annular lip section in the direction of its extension as the temperature changes. Therefore, even if Teflon (registered trademark) is used as a material for making the casing member, the working fluid or the fluid to be delivered can be prevented from leaking through the clamping portion to the outside.

In addition, the diaphragm can be prevented from being pulled out of the clamping portion between the main body section and the casing member during the reciprocating motions of the center rod.

In specific, the leakage of the fluid to be delivered can be prevented in a more reliable manner.

Further, the annular lip section can be pushed into the annular recess upon engaging the annular threaded member with the annular wall section, and therefore the operating efficiency can be improved.

Still further, even if Teflon (registered trademark) is used as a material for making the diaphragm, the center rod can be prevented from being pulled out of the diaphragm during the reciprocating motions of the center rod.

In specific, the leakage of the working fluid from the working fluid chamber to the outside can be prevented effectively.

What is claimed is:

1. A diaphragm-type pumping apparatus comprising:

a pair of disc-like diaphragms, each having a diaphragm section for defining a fluid delivering chamber and a working fluid chamber;

a main body section operatively supporting a center rod so as to allow a reciprocating motion thereof, said pair of diaphragms being attached at central portions thereof to respective ends of said center rod; and a pair of casing members arranged so as to hold said main body section from opposite sides thereof and functioning in association with said main body section to clamp peripheral portions of said respective diaphragms from opposite sides along a thickness direction thereof, wherein a fluid can be sucked through a fluid suction port and discharged from a fluid discharge port by reciprocating said center rod in response to a changeover in supplying a working fluid to said respective working fluid chambers, wherein at least one of said casing members is made of Teflon (registered trademark), each of said diaphragms has an annular lip section formed in an outer circumferential portion that is outside of the peripheral portion thereof, and the annular lip section extends along a direction of the reciprocating motion of said center rod and also along a thickness direction of the corresponding diaphragm, wherein each of said casing members is provided with an annular wall section forming an annular recess for accommodating an ingress of said annular lip section of said respective diaphragm, and wherein each of said annular wall sections is provided with a threaded section which engages an annular threaded member for compressing said annular lip section of said respective diaphragm toward a clamping portion between said main body section and said casing member.

2. A diaphragm-type pumping apparatus in accordance with claim 1, wherein each of said casing members has a communicating channel formed therein for providing communication between said fluid suction port and said fluid discharge port via said fluid delivering chamber.

3. A diaphragm-type pumping apparatus in accordance with claim 1, wherein at least one end of said main body section has a communicating channel formed therein for providing communication between said fluid suction port and said fluid discharge port via said fluid delivering chamber.

4. A diaphragm-type pumping apparatus in accordance with claim 1, wherein each of said annular recesses is formed such that an approach channel for said respective annular lip section is made to be narrower gradually from an entrance port toward an innermost portion thereof.

5. A diaphragm-type pumping apparatus in accordance with claim 1, wherein each of said annular threaded members comprises a compressing wall section for compressing said respective annular lip section directly or indirectly along a thread traveling direction in order to push said annular lip section into said respective annular recess.

6. A diaphragm-type pumping apparatus in accordance with claim 1, wherein at least one of said diaphragms is made of Teflon (registered trademark).

7. A diaphragm-type pumping apparatus in accordance with claim 1, further comprising an O-ring disposed in a contact location of said main body section with one of said annular lip sections.

8. A diaphragm-type pumping apparatus comprising:

a pair of disc-like diaphragms, each having a diaphragm section for defining a fluid delivering chamber and a working fluid chamber;

a main body section operatively supporting a center rod so as to allow a reciprocating motion thereof, said pair of diaphragms being attached at central portions thereof to respective ends of said center rod; and a pair of casing members arranged so as to hold said main body section from opposite sides thereof and functioning in association with said main body section to clamp peripheral portions of said respective diaphragms from opposite sides along a thickness direction thereof, wherein a fluid is sucked through a fluid suction port and discharged from a fluid discharge port by reciprocating said center rod in response to a change-over in supplying a working fluid to said respective working fluid chambers, wherein at least one of said casing members is made of Teflon (registered trademark), and each of said diaphragms has an annular lip section formed in an outer circumferential portion that is outside of the peripheral portion thereof, and said annular lip section extends along a direction of the reciprocating motion of said center rod and also along a thickness direction of the respective diaphragm, wherein said main body section is provided with annular wall sections at opposite sides thereof, and said annular wall sections define annular recesses for accommodating an ingress of said annular lip sections, respectively, and wherein an outer surface of each of said annular wall sections is provided with a threaded section, and annular threaded members are engaged with said threaded sections, respectively, for compressing said annular lip sections toward clamping portions between said main body section and said casing member.

9. A diaphragm-type pumping apparatus in accordance with claim 8, wherein each of said casing member has a communicating channel formed therein for providing communication between said fluid suction port and said fluid discharge port via said fluid delivering chamber.

10. A diaphragm-type pumping apparatus in accordance with claim 8, wherein at least one end of said main body section has a communicating channel formed therein for providing communication between said fluid suction port and said fluid discharge port via said fluid delivering chamber.

11. A diaphragm-type pumping apparatus in accordance with claim 8, wherein said annular recess is formed such that an approach channel for said annular lip section is made to be narrower gradually from an entrance port toward an innermost portion thereof.

12. A diaphragm-type pumping apparatus in accordance with claim 8, wherein each of said annular threaded members comprises a compressing wall section for compressing said annular lip section directly or indirectly along a thread traveling direction in order to push said annular lip section into said annular recess.

13. A diaphragm-type pumping apparatus in accordance with claim 8, wherein at least one of said diaphragms is made of Teflon (registered trademark).

14. A diaphragm-type pumping apparatus in accordance with claim 8, further comprising an O-ring disposed in a contact location of said main body section with one of said annular lip sections.

15. A diaphragm-type pumping apparatus comprising:

a pair of disc-like diaphragms, each having a diaphragm section for defining a fluid delivering chamber and a working fluid chamber;

a main body section operatively supporting a center rod so as to allow a reciprocating motion thereof, said pair of diaphragms being attached at central portions thereof to respective ends of said center rod;

a pair of casing members arranged so as to hold said main body section from opposite sides thereof and functioning in association with said main body section to clamp peripheral portions of said respective diaphragms from opposite sides along a thickness direction thereof, wherein a fluid can be sucked through a fluid suction port and discharged from a fluid discharge port by reciprocating said center rod in response to a change-over in supplying a working fluid to said respective working fluid chambers, wherein at least one of said casing members is made of Teflon (registered trademark), wherein each of said diaphragms has an annular lip section formed in an outer circumferential portion thereof and said annular lip section extends along a direction of a reciprocating motion of said center rod and also along a thickness direction of the corresponding diaphragm, wherein said casing members or said opposite sides of said main body section are provided with annular wall sections, respectively, and each of said annular wall sections forms an annular recess for accommodating said annular lip section of said respective diaphragm, wherein each of said diaphragms has a cylinder section formed in a central portion thereof, and each of said cylinder sections includes an inner threaded section formed on an inner surface thereof, and an outer threaded section formed on an outer surface thereof, and wherein said inner threaded sections are engaged with threaded sections of said center rod, respectively; and a pair of reinforcing ring members engaged with said outer threaded sections of said cylinder sections, respectively, so as to clamp said cylinder sections in association with said center rod.

16. A diaphragm-type pumping apparatus in accordance with claim 15, wherein each of said annular wall sections includes a threaded section formed on an outer surface thereof, and annular threaded members are engaged with said threaded sections of said annular wall sections, respectively, for compressing said annular lip section of said respective diaphragm.

17. A diaphragm-type pumping apparatus in accordance with claim 16, wherein each of said annular threaded members has a compressing wall section for compressing said annular lip section directly or indirectly along a thread traveling direction in order to push said annular lip section into said corresponding annular recess.

18. A diaphragm-type pumping apparatus in accordance with claim 15, wherein said reinforcing ring members are formed of one of polypropylene and polyvinyl chloride.

19. A diaphragm-type pumping apparatus in accordance with claim 15, wherein an O-ring is arranged in a contact location of said main body section with at least one of said annular lip sections.

20. A diaphragm-type pumping apparatus in accordance with claim 15, aid center rod is formed of PPS, and said annular recess is formed such that an approach channel for said annular lip section is made to be narrower gradually from an entrance port toward an innermost portion thereof.

* * * * *